United States Patent [19]

O'Leary

[11] Patent Number: 4,695,918

[45] Date of Patent: Sep. 22, 1987

[54] PRE-INSERTION INDUCTOR ARRANGEMENT

[75] Inventor: Raymond P. O'Leary, Evanston, Ill.

[73] Assignee: S&C Electric Company, Chicago, Ill.

[21] Appl. No.: 890,425

[22] Filed: Jul. 24, 1986

[51] Int. Cl.[4] ..... H01H 33/16

[52] U.S. Cl. ..... 361/58; 200/144 AP

[58] Field of Search ..... 361/2, 10, 11, 13, 58, 361/115; 200/144 R, 144 AP

[56] References Cited

U.S. PATENT DOCUMENTS

| | | | |
|---|---|---|---|
| 3,148,260 | 9/1964 | Upton, Jr. | 200/146 R |
| 3,376,475 | 4/1968 | Greber | 361/11 |
| 3,566,061 | 2/1971 | Bernatt | 200/144 R |
| 3,576,414 | 4/1971 | Mikos | 200/144 AP |
| 3,588,406 | 6/1971 | Bernatt | 200/144 AP |
| 3,614,530 | 10/1971 | Baltensperger | 361/10 |
| 3,697,773 | 10/1972 | Reitan et al. | 361/58 X |
| 3,763,340 | 10/1973 | Noack | 200/148 AP |
| 3,836,819 | 9/1974 | Clausing | 200/144 AP |
| 3,912,975 | 10/1975 | Knauer et al. | 361/58 |
| 3,927,350 | 12/1975 | McConnell | 200/144 AP |
| 4,069,406 | 1/1978 | Meinders | 200/144 AP |
| 4,072,836 | 2/1978 | Bischofberger et al. | 200/144 AP |
| 4,184,186 | 1/1980 | Barkan | 361/10 |
| 4,324,959 | 4/1982 | Hall et al. | 200/144 AP |
| 4,405,965 | 9/1983 | Weldon et al. | 361/58 X |
| 4,443,674 | 4/1984 | Calvino | 200/144 AP |
| 4,550,356 | 10/1985 | Takahashi | 361/9 |
| 4,567,538 | 1/1986 | Arimoto et al. | 361/58 |

OTHER PUBLICATIONS

Bayless, et al., "Capacitor Switching and Transformer Transients", 1986 IEEE PES Summer Meeting, Paper No. 86 SM 419-6.

*Primary Examiner*—A. D. Pellinen

*Assistant Examiner*—Derek S. Jennings

*Attorney, Agent, or Firm*—James V. Lapacek

[57] ABSTRACT

A pre-insertion inductor arrangement is provided for a circuit interrupting device or high voltage switch to reduce audible and electrical noise and to limit transient inrush current and/or voltages upon closing of the circuit by the circuit interrupting device or high voltage switch. The arrangement provides the insertion of the inductor for a plurality of cycles of the source frequency and thus does not require precise timing. The pre-insertion inductor does not require the use of a stack of resistor blocks or cakes of the prior art. Further, since the pre-insertion inductor has relatively low losses, the energy dissipation requirements of the pre-insertion inductor are significantly less than for pre-insertion resistors. Additionally, since the pre-insertion inductor is not continuously in the circuit, there is no requirement to carry continuous load or fault current or to accomodate losses on a continuous basis. Thus, an effective inductance for the pre-insertion inductor can be achieved in a desirable configuration having compact dimensions. In a specific embodiment, the pre-insertion inductor arrangement inserts the inductance between a switch blade and a switch contact during the closing movement of the switch blade. A conducting arm arrangement extends radially from the switch blade and upon movement of the switch blade the conducting arm arrangement is moved into juxtaposition with a conductor connected to the pre-insertion inductor assembly. The pre-insertion inductor assembly is mounted on and to one side of the stationary switch contact. The pre-insertion inductor assembly is connected in series with the switch blade and limits the transient inrush current and/or voltages incident to the closing of the switch.

19 Claims, 9 Drawing Figures

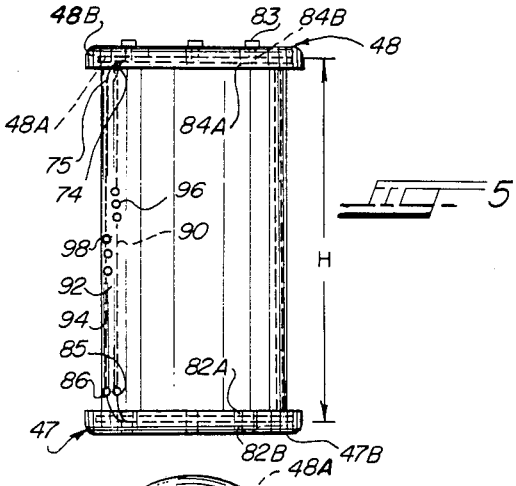
FIG. 5
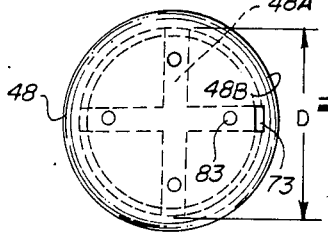
FIG. 6
FIG. 7
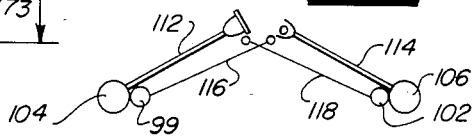
FIG. 8
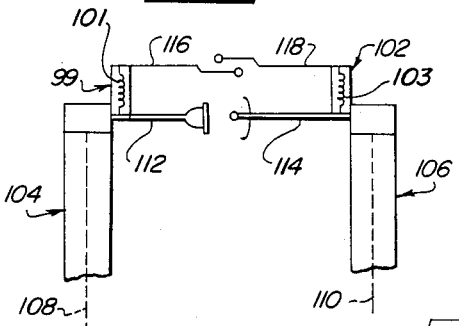
FIG. 9
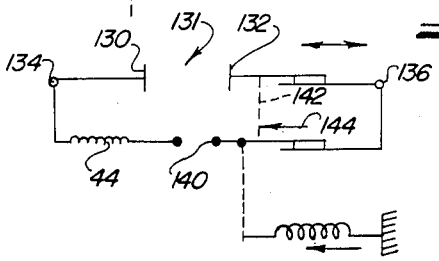

PRE-INSERTION INDUCTOR ARRANGEMENT

BACKGROUND OF THE INVENTION

1. Field of the Invention

The present invention relates generally to the field of high voltage switches and circuit interrupting devices and more particularly to a pre-insertion inductor arrangement to limit transient irush current and/or voltages during the closing of the circuit.

2. Related Art:

A number of prior art arrangements are directed to pre-insertion resistors for circuit interrupting devices wherein a resistor is either inserted in series with a high-voltage switch or in parallel with a switch gap during closing movement of the switch or interrupting unit to reduce audible and electrical noise and to limit transient inrush current and/or voltages incident to completion of the circuit by the switch or interrupting unit. For example, pre-insertion resistors of this type are shown in the following U.S. Pat. Nos.: 3,588,406; 3,576,414; 3,566,061; 3,763,340; 4,069,406; 4,072,836; and 4,324,959. Without the pre-insertion resistor, as the circuit interrupting device is closed, the inrush current may reach values of 10 to 30 thousand amperes where the circuit interrupting device is used in conjunction with back-to-back capacitor banks. Additionally, during single bank energization of a capacitor bank, large voltage transients may also be produced. Such transient current and/or voltages can produce undesirable noise, both audible and electrical, and can, of course, also lead to distress or damage of items connected to the circuit. For example, see Bayless, et al, "CAPACITOR SWITCHING AND TRANSFORMER TRANSIENTS," 1986 IEEE PES Summer Meeting, Paper No. 86 SM 419-6. With the pre-insertion resistor, the inrush current arising from back-to-back capacitor banks is limited to much lower values, perhaps in the range of 2 to 4 thousand amperes, which can be carried by the circuit without undue distress. Since the pre-insertion resistor is in the circuit only briefly during the closing of the circuit interrupting device, the pre-insertion resistor is not required to carry the continuous current of the circuit except during the portion of the insertion time after the inrush. However, the pre-insertion resistor must be designed to dissipate the power losses incurred during the insertion time; e.g., some fraction of a second, with the high frequency inrush current flowing during an initial portion of the insertion time followed by the 60 Hz capacitor-bank circuit current during the remainder of the insertion time. Pre-insertion resistors of this type are generally fabricated from a stack of cylindrical resistor cakes or blocks as illustrated in the aforementioned U.S. Pat. No. 3,576,414. It has been found that for the relatively long insertion-time applications referred to hereinbefore, it is difficult to achieve a resistor block that provides reliability over a desirable operating life. In addition, it would be desirable to use a pre-insertion resistor for certain large-size capacitor banks and/or where frequent switching may be required. However, the pre-insertion resistors of the prior art are not entirely suitable for these applications since it is difficult to achieve a pre-insertion resistor to reliably and frequently withstand the inrush current and the energy dissipated during the insertion time.

Another approach to damping or limiting the inrush current incident to the completion of the circuit by a high-voltage switch is the continuous, permanent connection of an inductor in the circuit. However, such an arrangement does have its drawbacks since the inductor must be designed to carry continuous load currents and fault currents. In addition, there are ongoing costs associated with the power losses in the inductor on a continuous basis. Accordingly, it is difficult to achieve an inductor of the desired capacity and inductance in a reasonable volume and at a reasonable cost.

A number of other prior art arrangements utilize various switched combinations of resistors, inductors and/or capacitors during switch opening or to damp voltage transients upon switch closing. For example, U.S. Pat. No. 4,443,674 utilizes precision timimg means for the insertion and removal of an impedance via impedance contacts 130 in parallel with the interrupter contacts 120 to damp voltage transients. The impedance contacts 130 are closed approximately 10 msec before the interrupter contacts 120 are closed and the impedance contacts 130 are opened several milliseconds after the interrupter contacts 120 are closed. In such a precision-timing insertion arrangement, the selection of the impedance is of no particular consequence since the duration of insertion is short and the energy dissipation in the impedance is relatively low. Other insertion arrangements of this type to limit fault currents or voltage transients during opening of a switch are disclosed in U.S. Pat. Nos. 3,912,975; 3,927,350; 3,836,819; 3,376,475; 3,148,260; 4,184,186; and 4,550,356. The arrangement of U.S. Pat. No. 3,614,530 is directed to the control of voltage transients and includes a bypass/parallel switch that is connected across a resistor to selectively insert the resistor to provide losses to a resonant circuit including the line capacitance and a shunt reactor that is in series with the parallel combination of the bypass/parallel switch and the resistor. The shunt branch of the reactor and switch-resistor combination are connected between the load side of the circuit breaker and ground. U.S. Pat. No. 4,567,538 illustrates a current-limiting apparatus including a switch that is operable upon the occurence of a fault in either of two power systems to limit current flowing between the two power systems. Two series circuits are connected in parallel with each other and between the two power system lines. The switch is connected between an intermediate point of each of the two series circuits so as to form a parallel-resonance circuit to limit current flowing between the power system lines when the switch is closed. When the switch is open, one of the series circuits is series-resonant so that the two series circuits provides a very low total impedance between the two power system lines.

While the aforementioned prior art arrangements may be suitable for their intended use in accordance with their respective defined applications, as discussed hereinbefore, it would be desirable to provide an efficient and compact insertion arrangement to limit transient inrush current and/or voltages while not requiring resistor blocks or precise timing of the insertion.

SUMMARY OF THE INVENTION

Accordingly, it is a principal object of the present invention to provide a pre-insertion inductor arrangement for a circuit interrupting device or high voltage switch that effectively limits transient inrush current and/or voltages during closing operation of the circuit interrupting device and that does not require high energy disipation or precise insertion timing.

It is a further object of the present invention to provide a pre-insertion inductor arrangement for a high voltage switch which effectively limits transient inrush current and/or voltages during circuit closing by insertion of the pre-insertion inductor for a plurality of cycles of the source frequency; the pre-insertion inductor arrangement being substantially the same size as and lighter in weight than prior art pre-insertion resistors and being easily added to many existing circuit interrupting devices.

These and other objects of the present invention are achieved by providing a pre-insertion inductor arrangement for a circuit interrupting device or high voltage switch to reduce audible and electrical noise and to limit transient inrush current and/or voltages upon closing of the circuit by the circuit interrupting device or high voltage switch. The arrangement provides the insertion of the inductor for a plurality of cycles of the source frequency and thus does not require precise timing. The pre-insertion inductor does not require the use of a stack of resistor blocks or cakes of the prior art. Further, since the pre-insertion inductor has relatively low losses, the energy dissipation requirements of the pre-insertion inductor are significantly less than for pre-insertion resistors. Additionally, since the pre-insertion inductor is not continuously in the circuit, there is no requirement to carry continuous load or fault current or to accomodate losses on a continuous basis. Thus, an effective inductance for the pre-insertion inductor can be achieved in a desirable configuration having compact dimensions. In a specific embodiment, the pre-insertion inductor arrangement inserts the inductance between a switch blade and a switch contact during the closing movement of the switch blade. A conducting arm arrangement extends radially from the switch blade and upon movement of the switch blade the conducting arm arrangement is moved into juxtaposition with a conductor connected to the pre-insertion inductor assembly. The pre-insertion inductor assembly is mounted on and to one side of the stationary switch contact. The pre-insertion inductor assembly is connected in series with the switch blade and limits the transient inrush current and/or voltages incident to the closing of the switch.

In another specific embodiment for application of the pre-insertion inductor arrangement to a center-break disconnect switch wherein a switch blade is carried by an insulator that is pivotable about a vertical axis, a pre-insertion inductor assembly is upstandingly mounted on and movable with each of the pivotable insulators so that the lower end of each pre-insertion inductor is electrically connected to a respective switch blade. A conducting arm extends from the other end of each pre-insertion inductor assembly toward the other arm to complete a conductive path in the atmosphere between their distal ends and through the pre-insertion inductor assemblies in advance of the completion of a conductive path through the switch blades of the center-break disconnecting switch as the switch blades move into contact engagement at their distal ends. In yet another specific embodiment, the pre-insertion inductor is arranged for insertion in parallel with the gap of a circuit interrupting device.

In these various arrangements, the pre-insertion inductors are shorted out and current no longer flows therethrough upon the completion of an electrical circuit through the switch blade and the stationary contact, or in the case of the center break disconnecting switch through the switch blades.

BRIEF DESCRIPTION OF THE DRAWING

The invention, both as to its organization and method of operation, together with further objects and advantages thereof, will best be understood by reference to the accompanying drawing in which:

FIG. 5 and 6 are front elevational and top plan views respectively of portions of the pre-insertion inductor assembly of FIGS. 1 and 2;

FIGS. 7 and 8 are top plan and front elevational diagrammatic representations respectively of another specific embodiment of the pre-insertion inductor arrangement of the present invention; and FIG. 9 is a diagrammatic and electrical schematic representation of yet another specific embodiment of the pre-insertion inductor arrangement of the present invention.

DETAILED DESCRIPTION

Figures 1, 3:
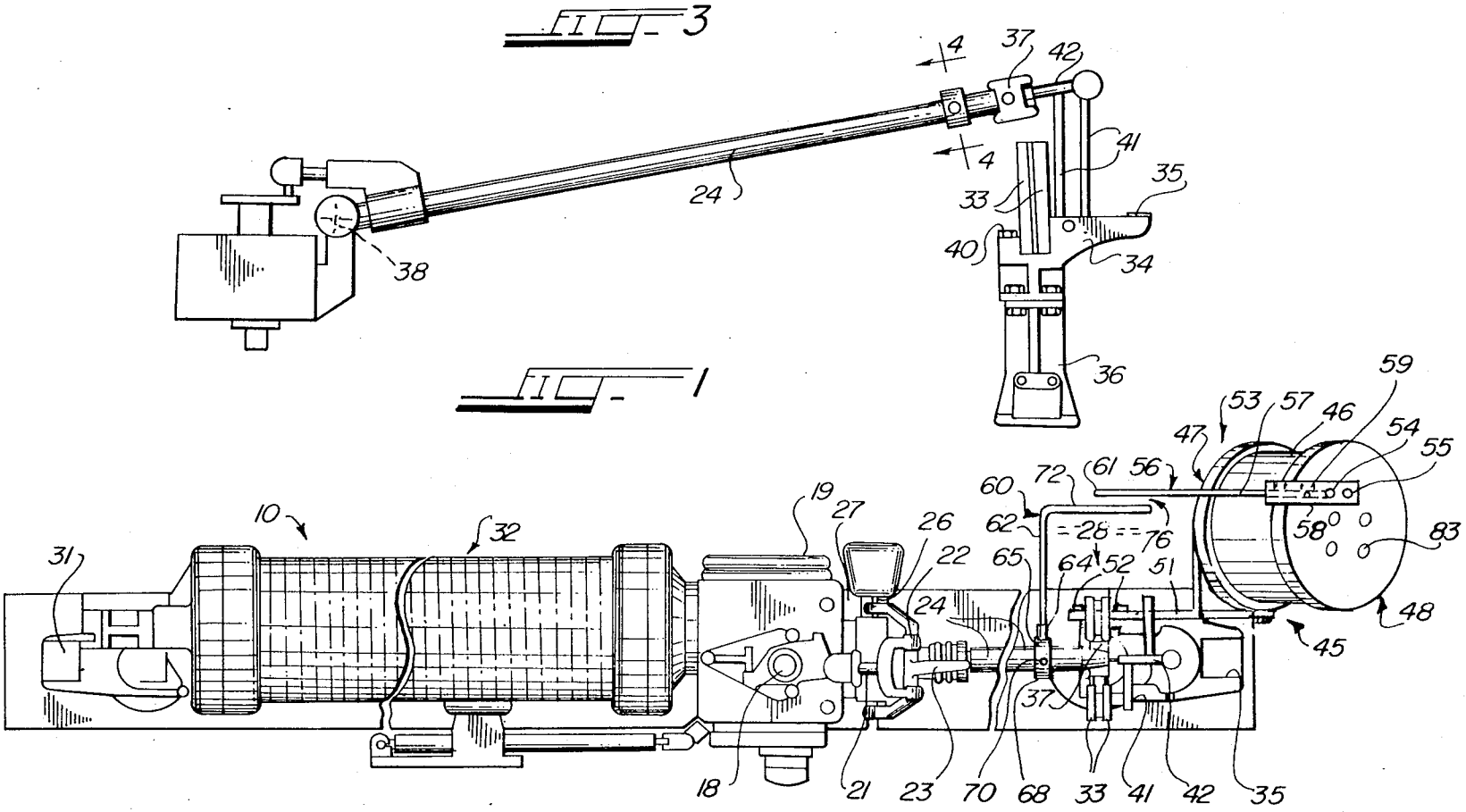
FIG. 1 is a top plan view of a circuit interrupting device provided with and illustrating a specific embodiment of the pre-insertion inductor arrangement of the present invention.
FIG. 3 is a front elevational view of portions of the circuit interrupting device of FIG. 1 illustrating how the conducting arm arrangement is oriented on the disconnect switch blade.
Figures 2, 4:
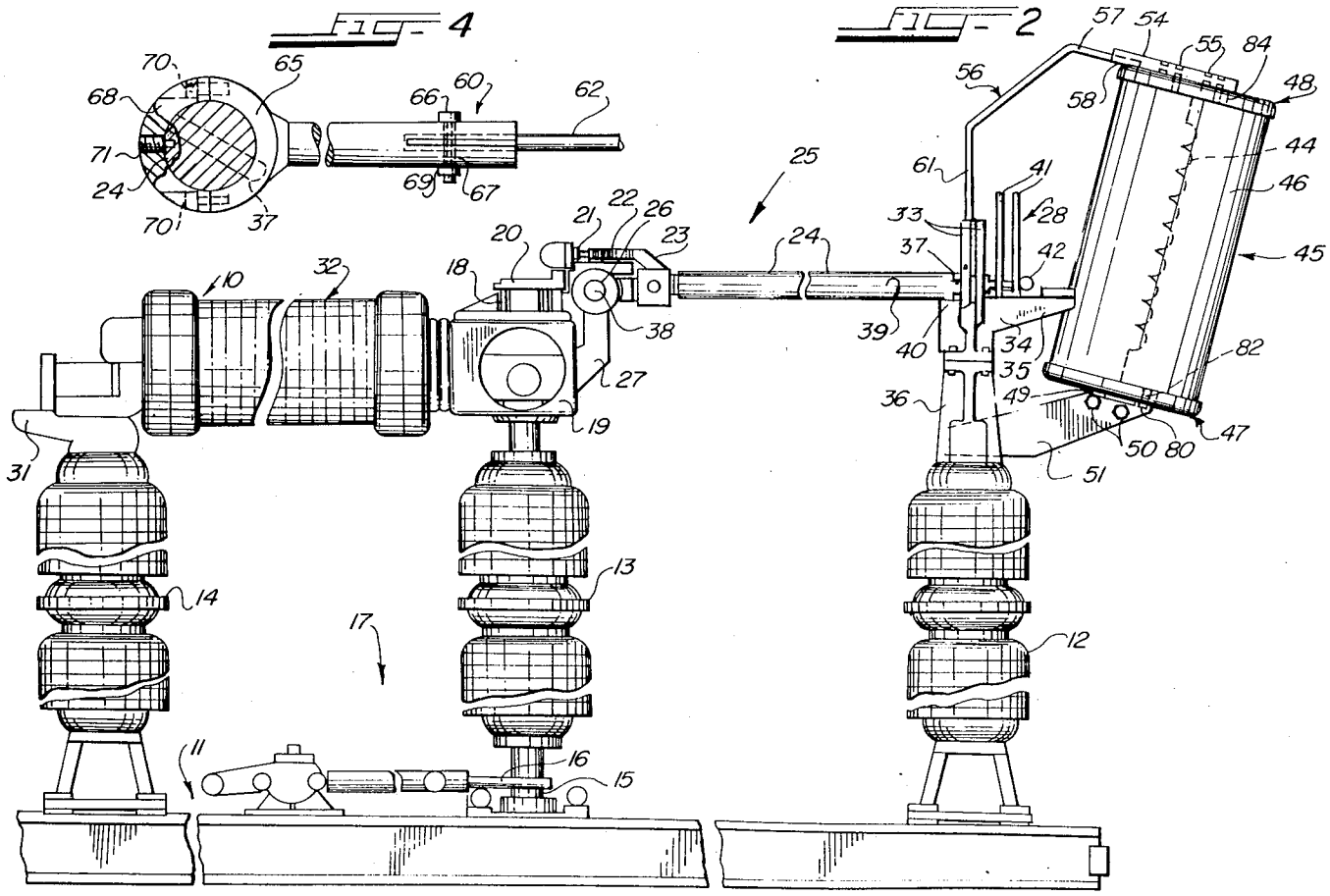
FIG. 2 is a elevational view of the circuit interrupting device and pre-insertion inductor arrangement of FIG. 1.
FIG. 4 is a sectional view taken generally along the line 4—4 of FIG. 3.

Referring now particularly to FIGS. 1 and 2, a circuit interrupting device generally referred to at 10 includes the pre-insertion inductor arrangement of the present invention. The circuit interrupting device 10 includes a base, indicated generally at 11, that may be formed of a pair of aluminum channels suitably secured together. Mounted on the base 11 are a first insulator 12, a second insulator 13, which is rotatable, and a third insulator 14. The second insulator 13 is rotatably mounted on a bearing 15 that is carried by the base 11 and it has an arm 16 extending therefrom for connection to a suitable operating linkage that is indicated, generally, a 17. It will be understood that, for three phase operation, three of the circuit interrupting devices 10 are mounted on a suitable switching structure in proper spaced relation, depending upon the voltage of the circuit. It should also be understood that suitable operating means, common to the operating linkage 17, is provided for effecting the simulataneous rotation of the second insulator 13 of each circuit interrupting device 10 for effecting simultaneous operation for either opening or closing the circuit as may be required. Circuit interrupting devices of this type are disclosed in U.S. Pat. Nos. 3,769,477 and 3,588,406.

Extending upwardly from and rotatable with the second insulator 13 is a shaft 18. The shaft 18 extends through and is rotatably mounted on a mechanism housing 19. At its upper end the shaft 18 carries a switch crank 20 which is rotatable therewith. The switch crank 20 is pivotally connected to a link 21 that is pivoted at 22 to an arm 23 which extends from a switch blade 24 that forms a part of a disconnecting switch that is indicated, generally, at 25. The switch blade 24, which may also be referred to as a disconnect blade, is pivoted at 26 on a bracket 27 which is carried by one wall of the mechanism housing 19. At its distal end, the switch blade 24 is arranged to move into and out of high pressure contact engagement with a line contact member, shown generally at 28, which is carried by the first insulator 12. It will be understood that, on rotation of the second insulator 13 by the operating linkage 17, a corresponding rotation of the switch crank 20 is effected for swinging the switch blade 24 out of or into high pressure contact engagement with the line contact member 28, depending upon the direction of rotation.

It is desirable that the switch blade 24 be opened only after the circuit has been opened previously by some other means. The reason for this is to prevent the drawing of an arc between the distal end of the switch blade 24 and the line contact member 28 when the circuit is interrupted under load which might result in damage to these parts or in the creation of a fault by arcing over to an adjacent phase or to ground. For this purpose, a circuit interrupter generally indicated at 32 is mounted between the mechanism housing 19 and a line terminal 31, which is carried by the third insulator 14. Separable contact means are provided in the circuit interrupter 32; the contact means being operated by the mechanism within the mechanism housing 19 under the control of the shaft 18.

The line contact member 28 includes inverted U-shaped contact fingers 33 which are suitably mounted on a terminal member 34 from which a line terminal 35 extends for connection to a line conductor. The terminal member 34 is suitably mounted on a line contact member support 36 which is directly supported by the first insulator 12.

In order to provide for high pressure contact engagement between the switch blade 24 and the inverted U-shaped contact fingers 33, the switch blade 24 is provided near its distal end with a plate section 37 that is arranged to enter between the contact fingers 33 at an angle when the switch blade 24 is swung toward the switch-closed position about a pivot axis 38 through the pivot 26 on the bracket 27. The pivot axis 38 is at right angles to the longitudinal axis 39 of the switch blade 24. The closing movement of the switch blade 24 is arrested when it engages a stop 40. During the final closing action, the switch blade 24 is rotated about the longitudinal axis 39 to move the plate section 37 to a position at right angles to the contact fingers 33 and thus into high pressure contact engagement therewith.

With a view to preventing arcing between the switch blade 24 and the contact fingers 33 when the switch blade 24 is swung toward the closing position, inverted U-shaped arcing fingers 41 are mounted on the terminal member 34 and are arranged to be engaged by an arcing tip 42 that projects from the switch blade 24. As the switch blade 24 is swung toward the closing position, it will be understood that the arcing tip 42 approaches the arcing fingers 41 before coming within arcing distance of the contact fingers 33.

As pointed out hereinbefore, it is likely that there may be substantial transient inrush current and/or voltages in the circuit in which the circuit interrupting device 10 is connected. For example, this may be due to a capacitor bank being connected to one of the line terminals 31 or 35. In order to limit the transient inrush current and/or voltages, a pre-insertion inductor 44 is arranged to be connected in series with the circuit and particularly in series with the switch blade 24 as it is being swung toward the closed position. The pre-insertion inductor 44 is chosen so as to have sufficient electrical and thermal capacity to withstand, momentarily, the current flow that is likely to take place therethrough on closure of the switch blade 24.

The pre-insertion inductor 44 forms a part of a pre-insertion inductor assembly generally indicated at 45. The pre-insertion inductor 44 includes a lower end terminal 47 and an upper end terminal 48 between which the pre-insertion inductor 44 is connected as illustrated by the cylindrical component 46. A conductor extension and support plate 49, FIG. 1, is connected to the lower end terminal 47 via bolts 80 within tapped holes 82 in the lower end terminal 47. The extension and support plate 49 is secured by bolts 50 to a metallic bracket 51. The bracket 51 is secured by bolts 52 to the line contact member 36. Accordingly, the lower end of the pre-insertion inductor 44 is electrically connected to the line terminal 35. A conductor extension, indicated generally at 53, is connected to the upper end terminal 48. The conductor extension 53 includes a conductor to the upper end secured by bolts 55 to the upper end terminal 48. The conductor extension 53 also includes a terminal rod 56. The terminal rod 56 has an end section 57 that extends into an opening 58 in the conductor plate 54 and is secured therein by set screws 59 or the like. The terminal rod 56 also includes a depending arcing section 61 which is positioned generally parallel to the line contact member 28 and is located in spaced relation thereto as indicated in FIG. 1.

By positioning the presinsertion inductor assembly 45 in offset relation with respect to the line contact member 28 and in offset relation with respect to the plane in which the switch blade 24 is pivoted about axis 38, there is no interference with the operation of the switch blade 24 or with a conductor that may be connected to the line terminal 35. Thus it is possible to apply the pre-insertion inductor assembly 45 to a switch construction that is already connected in service in a high-voltage transmission line.

In order to place the pre-insertion inductor 44 in circuit with the switch blade 24 as it is being moved toward the closed position, a conducting arm assembly, indicated generally at 60, is provided. The conducting arm assembly 60 includes a conducting rod 62 that extends radially from the switch blade 24. As shown more clearly in FIG. 4, the conducting rod 62 is secured within a split-sleeve receiver 64 of a semicircular clamp 65. The conducting rod 62 is clamped wihin the receiver 64 by means of a bolt 66 disposed through a passage 67 in the receiver 64 and a nut 69 threaded on the bolt 66. A mating semicircular clamp 68 cooperates with the clamp 65 to secure the conducting arm 62 in place on the switch blade 24. Socket head cap screws 70 interconnect the clamps 65 and 68. In addition, a set screw 71 extends through the central portion of the clamp 69 and into the switch blade 24 in order to accurately position the conducting arm 62.

The conducting rod 62 at its distal end includes a contact section 72 extending at a right angle to the main portion of the conducting rod 62 and into overlying relation with the depending arcing section 61 of the terminal rod 56 when the switch blade 24 is swung toward the closed position. Preferably the relation between the depending arcing section 61 and the contact section 72 is such that a uniform gap, e.g. 0.125–0.50 inch as indicated at 76 is provided therebetween. This ensures that the contact section 72 can move freely with respect to the depending arcing section 61. The voltage at which the device 10 ordinarily operates is such that the relatively small gap 76 is promptly arced over as the switch blade 24 is moved toward the switch-closed position illustrated in FIGS. 1 and 2; i.e., arcing is initiated in the gap 76 at a predetermined point in the closing movement to complete an electrical path.

It is desirable that the conducting rod 62 be located accurately on the switch blade 24 in a horizontal sense to provide the proper relationship betweenthe contact section 72 and the depending arcing section 61 as the switch blade 24 is swung toward the closed position. This is accomplished by positioning the conducting arm assembly 60 on the switch blade 24 when the switch blade 24, as indicated in FIG. 3, is at an angle of about 10° from its fully closed position. When the switch blade 24 is so located, the conducting arm 62 is clamped in position such that it extends horizontally or parallel to the base 11, assuming that it is in a horizontal position. Then the cap screw 70 are tightened and the set screw 71 is screwed into place to positively hold the conducting arm assembly 60 in position on the switch blade 24.

When the switch crank 20 rotates as the result of the rotation of the second insulator 13, the switch blade 24 is swung toward the switch-closed position about the pivot axis 38; the plate section 37 being located at an angle of about 30° with respect to the horizontal. This condition is maintained as the switch blade 24 is rotated to the position shown in FIG. 3 which also is shown in FIGS. 1 and 2. This facilitates entry of the plate section 37 between the contact fingers 33. As the movement of the switch blade 24 continues about the pivot axis 38, the distal end of the switch blade 24 engages the stop 40. Continued movement of the switch crank 20 effects pivotal movement of the switch blade 24 about the longitudinal axis 39 to position the plate section 37 substantially horizontal or at right angles to the contact fingers 33. This is accompanied by a corresponding movement of the conducting rod 62 and contact section 72 away from the depending arcing section 61 to the position indicated by broken lines for the contact finger 72 in FIG. 1.

With the circuit interrupting device 10 connected in an electrical circuit, as soon as the contact section 72 aproaches the upper end of the depending arcing section 61 of the terminal rod 56 in the closing movement of the switch blade 24, arcing is established therebetween and current begins to flow through the pre-insertion inductor 44. Because of its impedance, this current flow is limited and there is a reduction in the transient inrush current and/or voltages. The closing movement of the switch blade 24 continues with the transients having been limited by the pre-insertion inductor 44. The arcing tip 42 engages the arcing fingers 41 and shortly thereafter the plate section 37 engages the contact fingers 33 with the result that the pre-insertion inductor 44 is short circuited and current no longer flows through it.

When it is desired to interrupt the circuit, the second insulator 13 is rotated in a reverse direction, there is a corresponding reverse movement of the shaft 18 and of the switch crank 20. Concerning a specific example of the current interrupting device 12, before the switch blade 24 disengages the line contact member 28, the current interrupter 32 is operated to open the circuit under the control of the mechanism within the mechanism housing 19. Then continued rotation of the second insulator 13 in an opening direction swings the switch blade 24 out of high pressure contact engagement with the contact fingers 33 and to an open circuit position which is substantially at right angles to its switch-closed position. During the final portion of the opening movement of the switch blade 24, the mechanism within the mechanism housing 19 is arranged to reclose the circuit interrupter 32. Thus, in the switch-open position, the contacts of the circuit interrupter 32 are closed while the switch blade 24 occupies a generally upright position.

As pointed out above, the pre-insertion inductor assembly 45 is offset to one side of the line contact member 28. In addition, it is inclined away from the line contact member 28 in order to permit the construction of the terminal rod 56 with substantial flexibility between the upper end of the pre-insertion inductor assembly 45 and the depending arcing section 61.

Referring now additionally to FIGS. 5 and 6, an illustration of a suitable pre-insertion inductor 44 for the practice of the present invention is embodied by the cylindrical component 46 of the pre-insertion inductor assembly 45. The lower end terminal 47 and the upper end terminal 48 each include a generally X-shaped mounting member 47A,48A respectively which are suitably fastened at 73 to the cylindrical component 46. The end caps 47B,48B of the end terminals 47,48 are optional. When utilized, the end cap 47B is attached to the mounting member 47A via the bolts 80 upon the mounting of the pre-insertion inductor assembly 45 to the circuit interrupting device 10. Of course, the end cap 48B may be attached to the mounting member 48A via bolts 83 prior to mounting of the pre-insertion inductor assembly 45 to the circuit interrupting device 10. Each of the end caps 47B,48B include passages 82B,84B that are aligned with the threaded passages or tapped holes 82A,84A in the respective mounting members 47A,48A.

The pre-insertion inductor 44 is generally fabricated as an inductor including a predetermined plurality of turns of wire to provide a desired inductance, a suitable resistance, and a suitable shape factor and volume defined by the dimensions H and D. In a specific embodiment, the cylindrical component 46 is fabricated as a hollow cylinder or cylindrical shell in accordance with the known process wherein fiberglass strands of material are treated with epoxy and built up or set on a collapsible mandrel along with the desired turns of wire. Inductors that are fabricated using this process are available, for example, from Trench Electric of Toronto, Canada. For example, in a specific embodiment, the cylindrical component 46 is fabricated to provide the pre-insertion inductor 44 by this process and utilizestwo or more concentric layers of wires with epoxy-dipped fiberglass material being usedto provide circumferential layers between the layers of wire and also to coat or encapsulate the wires on the inside and outside of the hollow cylinder 46. After the various layers are cured, the mandrel is collapsed and removed. Each layer of wire forms an inductor and the various layers are connected in parallel to provide the desired overall inductance and resistance for the pre-insertion inductor 44. For illustrative purposes, in FIG. 5, the layers of epoxy-dipped fiberglass material are referred to at 90,92 and 94 and the layers of wire are referred to at 96,98. Additionally, the upper ends 74,75 of the wire layers 96,98 respectively are connected to each other and to the upper mounting member 48A. Similarly, the lower ends 85,86 of the wire layers 96,98 respectively are connected to each other and to the lower mounting member 47A.

As a specific illustration for the practice of the present invention to effectively limit the transient inrush current and/or voltages during closing ofa circuit interrupting device for operation in the range of 115 to 138 kv, a pre-insertion inductor 44 having an inductance of 10 millihenries can be used with the dimension D being 25–35 cm. and H being approximately 60 to 75 cm. Such an inductance can be fabricated with a DC resistance of approximately 2.5 to 3 ohms. Accordingly, while the pre-insertion inductor 44 presents approximately 4 ohms of reactance at 60 Hz, it presents approximately 20 or more ohms of reactance at the surge frequencies during the limitation of the inrush current for back-to-back capacitor bank configurations; the reactance at the surge frequency being determined by the size of the capacitor bank connected to the circuit interrupting device. Additionally, while the DC resistance of 2.5 to 3 ohms could be lowered via the use of different wire or different construction techniques, the resistance is sufficiently low to limit energy dissipation, contributes to damping and is therefore desirable. Therefore, the present invention includes the presence of resistance in the pre-insertion inductor and the selection of desired X/R ratios of the inductive reactance to resistance in accordance with desired parameters such as the limitation of inrush current, the size of the capacitor bank, the duty cycle and the size of the pre-insertion inductor 44; the X/R ratio of the inductive reactance to resistance of the pre-insertion inductor 44 is selected to enhance or achieve predetermined damping at the inrush-current frequency and to minimize or limit energy dissipation at the source frequency. In a specific arrangement, the X/R ratio at the inrush frequency is at least 1. In another specific arrangement, the X/R ratio at the source frequency is at least 0.3. It should be realized that the foregoing parameters are to be interpreted in an illustrative sense and not in any limiting sense. For example, for specific applications, the resistance of the pre-insertion inductor 44 is approximately equal to the surge impedance resulting from the pre-insertion inductor and the capacitor bank being switched to thereby provide critical damping.

Considering other illustrative applications and specific embodiments of the pre-insertion inductor arrangement of the present invention, the pre-insertion inductor assembly of the present invention is suitable for use with the circuit interrupting devices disclosed in U.S. Pat. Nos. 3,576,414, 3,566,061 and 4,324,959 which are hereby incorporated by reference for all purposes. For example, the pre-insertion inductor assembly 45 can be utilized for the resistor assemblies 53 and 54 of the '414 patent; the resistor assemblies 60 of the '061 patent; and the stack of pre-insertion resistors 100 of the '959 patent. Referring now to FIGS. 7 and 8, two pre-insertion inductor assemblies 99, 102, each identical to the pre-insertion assembly 45 and having respective pre-insertion inductors 101,103, are illustrated for use with a center-break disconnecting switch of the type shown in the aforementioned U.S. Pat. No. 3,576,414. Each pre-insertion inductor assembly 99,102 is upstandingly mounted on and movable with a respective insulator 104,106 that is pivotable about a respective vertical axis 108,110. Each of the switch blades 112,114 is mounted on a respective one of the pivotable insulators 104,106. The lower end of each pre-insertion inductor 101,103 is electrically connected to a respective switch blade 112,114. A conducting arm 116,118 extends from the upper end of a respective pre-insertion inductor assembly 99,102 toward the other conducting arm with the upper end of each pre-insertion inductor 101,103 being electrically connected to the respective conducting arm 116,118. A gap 120 is formed between the conducting arms 116,118 during closure of the switch blades 112,114; this gap 120 being shorter than the gap between the distal ends of the switch blades. When the switch blades 112,114 are pivoted toward closure such that the gap 120 between the conducting arms 116,118 arcs over, a conductive path is established through the pre-insertion inductors 99,103 in advance of the completion of a conductive path through the switch blades 112,114.

Referring now to FIG. 9, the pre-insertion inductor 44 of the pre-insertion inductor assembly is illustrated for use with a circuit interrupting device of the type shown in the aforementioned U.S. Pat. No. 4,324,959. The circuit interrupting device includes a pair of normally-engaged contacts 130,132; one of the contacts 132 being movable relative to the other, stationary contact 130 to selectively separate the contacts to open a gap 131 therebetween to effect circuit interruption. The contacts 130,132 are continuously, electrically connected to respective circuit terminals 134,136. One end of the pre-insertion inductor 44 is connected to the stationary contact 130 at the circuit terminal 134. The other end of the pre-insertion inductor 44 is electrically connected to a stationary electrode 138. A movable electrode assembly 140 is electrically connected to the other circuit terminal 136 and mechanically coupled as represented at 142 to the movable contact 132. Upon movement of the movable contact 132 away from the contact 130 to open the gap 131, the movable electrode 140 simultaneously separates from the stationary electrode 138. However, after predetermined movement of the movable electrode 140, a latch represented at 144 uncouples the movable electrode 140 from the movable contact 132. When the contacts 130,132 are reengaged, the movable electrode 140 leads the movable contact 132 so that the movable electrode 140 reengages the stationary electrode 138 prior to the engagement of the contacts 130,132; the pre-insertion inductor 44 thereby being in parallel with the gap 131 between the contacts 130,132.

Accordingly, in the various applications of the pre-insertion inductor assembly 45, the inductor 44 is inserted for a plurality of cycles of the source frequency to limit transient inrush current and/or voltages upon the closing of the contacts of a circuit interrupting device or switch, e.g., 100–200 milliseconds in a particular application. Further, since the pre-insertion inductor 44 is utilized at the transient frequencies for the reactance thereof, the heat dissipation requirements are much lower than a permanently-connected inductor or a pre-insertion resistor of the same effective impedance even though precision timing is not relied upon to limit the energy dissipation. Additionally, the relatively short time of insertion in the circuit eliminates the requirements for the inductor 44 to withstand high continuous currents and to dissipate the resultant energy due to losses.

While there have been illustrated and described various embodiments of the present invention, it will be apparent that various changes and modifications will occur to those skilled in the art. For example, it should be realized that the pre-insertion inductor arrangement may be utilized with many different types of high voltages switches with or without the provision of separate interrupting units. It is intended in the appended claims to cover all such changes and modifications as fall within the true spirit and scope of the present invention.

What is claimed and desired to be secured by Letters Patent of the United States is:

1. A pre-insertion inductor arrangement utilized with a high voltage switch and being inserted into a circuit having an applied source voltage and source frequency to limit the transient inrush current and/or voltages in the circuit during closure of the switch, the pre-insertion inductor arrangement comprising a pre-insertion inductor and means for inserting said pre-insertion inductor for a plurality of cycles of the source frequency during closure of the switch.

2. The pre-insertion inductor arrangement of claim 1 wherein the high voltage switch includes a stationary contact and a switch blade which is pivoted between open and closed positions with respect to the stationary contact, said inserting means including conductive means carried by and extending from the switch blade, said inserting means further including terminal conductive means extending from and electrically connected to one end of said pre-insertion inductor, the other end of said pre-insertion inductor being electrically connected to the stationary contact, said conductive means and said terminal conductive means completing an electrical path between the switch blade and the stationary terminal through said pre-insertion inductor during closing movement of the switch blade toward the stationary contact.

3. The pre-insertion inductor arrangement of claim 2 wherein said conductive means and said terminal conductive means are arranged so as to define a predetermined gap of separation therebetween over a predetermined range of movement of the switch blade.

4. The pre-insertion inductor arrangement of claim 3 wherein the source voltage applied to the circuit defines said predetermined gap such that arcing is initiated in said gap at a predetermined point in the closing movement.

5. The pre-insertion inductor arrangement of claim 1 wherein said pre-insertion inductor has an X/R ratio of inductive reactance to resistance that is selected to enhance damping at the inrush-current frequency and to minimize energy dissipation at the source frequency.

6. The pre-insertion inductor arrangement of claim 1 wherein said pre-insertion inductor has an X/R ratio of inductive reactance to resistance that is selected to achieve predetermined damping at the inrush frequency while limiting energy dissipation at the source frequency.

7. The pre-insertion inductor arrangement of claim 1 wherein said pre-insertion inductor has an X/R ratio of inductive reactance to resistance at the inrush frequency of at least 1.

8. The pre-insertion inductor arrangement of claim 1 wherein said pre-insertion inductor has an X/R ratio of inductive reactance to resistance at the source frequency of at least 3.

9. The pre-insertion inductor arrangement of claim 1 wherein said pre-insertion inductor includes resistance that is a predetermined value to contribute to damping of the inrush transients.

10. The pre-insertion inductor arrangement of claim 1 wherein said pre-insertion inductor includes resistance that is approximately equal to the surge impedance defined by the inductance of said pre-insertion inductor and the circuit being switched so as to provide critical damping.

11. The pre-insertion inductor arrangement of claim 10 wherein the circuit includes a capacitor bank.

12. A pre-insertion inductor arrangement for use with a high voltage switch and for insertion into a circuit to limit the transient inrush current and/or voltages in the circuit during closure of the high voltage switch, the pre-insertion inductor arrangement comprising a pre-insertion inductor having an impedance and means for inserting said pre-insertion inductor for a plurality of cycles of thesource frequency during closure of the high voltage switch, the impedance of said pre-insertion inductor being predominantly inductive reactance at the frequency of transients and substantially inductive reactance at the source frequency.

13. An inductor-inserting arrangement (for use) utilized to limit transient inrush current and/or voltage in a circuit with a high voltage switch having a stationary switch contact and a cooperating switch blade pivoted about an axis perpendicular to the longitudinal axis of the switch blade, the switch blade being pivoted so the distal end moves toward and away from the stationary contact, the inductor-inserting arrangement comprising:

an inductor assembly having one end mounted on and electrically connected to the stationary switch contact so as to be to one side of the plane of the pivotal movement of the switch blade, said inductor assembly including an inductor having an impedance and a predetermined X/R ratio of inductive reactance to resistance at predetermined frequencies;

terminal conductor means connected to and extending from the other end of said inductor assembly and having a distal end for providing an arcing section disposed in a generally parallel and offset relation to the plane of pivotal movement of the switch blade; and conducting arm means carried by and radially extending from the switch blade near the end of the switch blade distal from the pivot axis for forming a current-conducting are to said arcing section of said terminal conductor means when the switch blade is pivoted toward the stationary switch contact to thereby connect said inductor in series with the switch blade and the stationary contact, said inductor limiting the inrush current through the circuit during closure of the switch blade, the inrush current defining said predetermined frequencies in accordance with the impedance of said pre-insertion inductor and the circuit being switched.

14. An inductor-inserting switch construction having a pair of parallel, spaced-apart insulators pivotally mounted at one end about the respective longitudinal axis, each insulator having a switch blade at its other end movable therewith for contact engagement at its distal end with the other switch blade on conjoint pivotal movement of said insulators, said switch construction being utilized to limit transient inrush current and/or voltage in a circuit and being characterized by:

a first conductor arm mounted on, electrically connected to one of said switch blades, extending therealong and movable unitarily therewith;

an inductor assembly mounted on and electrically connected at one end to the other of said switch blades and movable unitarily therewith; and a second conductor arm mounted on, movable with, and electrically connected at one end to the other end of said inductor assembly and extending toward said first conductor arm to complete a conductive path in the atmosphere between the distal ends of said arms through said inductor assembly in advance of completion of a conductive path through said switch blades as they are swung toward contact engagement at their distal ends during closing movement, said distal ends of said arms being spaced apart in the closed position of said switch blades in a direction generally perpendicular to the plane of movement of said switch blades, said inductor assembly limiting the transient inrush current and/or voltages during closing movement of said switch blades.

15. The inductor-insering switch construction of claim 14 wherein said inductor assembly includes an inductor having a predetermined X/R ratio of inductive reactance to resistance at predetermined frequencies, said predetermined X/R ratio being at least 1, the inrush current defining said predetermined frequencies in accordance with the impedance of said pre-insertion inductor and the circuit being switched.

16. An inductor-inserting switch construction having a pair of parallel, spaced-apart insulators pivotally mounted at one end about the respective longitudinal axis, each insulator having a switch blade at its other end movable therewith for contact engagement at its distal end with the other switch blade on conjoint pivotal movement of said insulators, said switch construction being utilized to limit transient inrush current and/or voltages in a circuit and being characterized by:

an inductor assembly mounted on and electrically connected at one end to each switch blade and movable unitarily therewith; and a conductor arm mounted on, movable with, and electrically connected at one end to the other end of each inductor assembly and extending toward the other arm to complete a conductive path in the atmosphere between the distal ends of said arms and through said inductor assemblies in advance of completion of a conductive path through said switch blades as they are swung toward contact engagement at their distal ends, said distal ends of said arms being spaced apart in the closed position of said switch blades, said inductor assemblies limiting the transient inrush current and/or voltages during closing movement of said switch blades.

17. The inductor-inserting switch construction of claim 16 wherein each of said inductor assemblies includes an inductor having a predetermined X/R ratio of inductive reactance to resistance at predetermined frequencies, said predetermined X/R ratio being at least 1, the inrush current defining said predetermined frequencies in accordance with the impedance of said pre-insertion inductor and the circuit being switched.

18. An inductor-inserting arrangement for a circuit interrupting device of the type having a pair of normally engaged contacts, at least one of which is relatively movable along a first path, the contacts being selectively disengageable and engageable by such movement to open and close a gap therebetween, each contact being continuously, electrically connected to respective, opposed, circuit-connectable terminals on the device, the inductor-inserting arrangement being utilized to limit transient inrush current and/or voltages in a circuit and comprising:

a pre-insertion inductor mechanism, which includes:

an inductor continuously, electrically connected at one end to one of the terminals, the other end of said inductor carrying a stationary electrode;

a movable electrode continuously, electrically connected to the other terminal and movable along a second path parallel to the first path into and out of engagement with the stationary electrode;

first means, responsive to movement of the one contact in a first direction along the first path, for moving the movable electrode in the first direction along the second path out of engagement with the stationary electrode so that said inductor is not in electrical parallel with the gap during such movements in the first direction; and second means, responsive to a predetermined amount of movement of the one contact in the first direction, for moving the movable electrode along the second path in a second direction toward the stationary electrode, so that the electrodes complete an electrical path prior to the formation of an arc between the contacts due to the one contact moving toward the other contact in the second direction and said pre-insertion inductor mechanism limiting the transient inrush current and/or voltages.

19. The inductor-inserting arrangement of claim 18 wherein said inductor has a predetermined X/R ratio of inductive reactance to resistance at predetermined frequencies, said predetermined X/R ratio being at least 1, said inductor limiting the inrush current in advance of engagement of said contacts, the inrush current defining said predetermined frequencies in accordance with the impedance of said inductor and the circuit being switched.

* * * * *

UNITED STATES PATENT AND TRADEMARK OFFICE

CERTIFICATE OF CORRECTION

PATENT NO. : 4,695,918

DATED : September 22, 1987

INVENTOR(S) : Raymond P. O'Leary

It is certified that error appears in the above-identified patent and that said Letters Patent is hereby corrected as shown below:

Col. 2, line 42, "occurence" should be -- occurrence --.

Col. 3, line 2, "disipation" should be -- dissipation --.

Col. 4, line 14, "a" should be -- an --;
line 23, "FIG." should be -- FIGS. --;
line 47, "a" should be -- at --;

Col. 6, lines 21-23, "The conductor extension 53 includes a conductor to the upper end secured by bolts 55 to the upper end terminal 48." should be -- The conductor extension 53 includes a conductor plate 54 that is secured by bolts 55 to the upper end terminal 48. --

Col. 6, line 31, "preinsertion" should be -- pre-insertion --;
line 49, "wihin" should be -- within --;
line 53, "conducting arm 62" should be -- conducting rod 62 --;
line 58, "conducting arm 62" should be -- conducting rod 62 --;

Col. 7, line 10, "betweenthe" should be -- between the --;
line 20, "screw" should be -- screws --;
line 46, "aproaches" should be -- approaches --;

Col. 8, lines 53-54, "utilizestwo" should be -- utilizes two --;
line 55, "usedto" should be -- used to --;

Col. 9, line 6, "ofa" should be -- of a --;

Claim 8, col. 11, line 62 "3." should be -- 0.3. --
Claim 12, col. 12, line 14, "thesource" should be -- the source --;
Claim 13, col. 12, line 19, delete "(for use)";
col. 12, line 20, "voltage" should be -- voltages --;
col. 12, line 46, "are" should be -- arc --;
Claim 14, col. 12, lines 64 and 65, "and/-or" should be -- and/or -- (no hyphen);
col. 12, line 65, "voltage" should be -- voltages --;
Claim 15, col. 13, line 21, "inductor-insering" should be -- inductor-inserting --.

UNITED STATES PATENT AND TRADEMARK OFFICE

CERTIFICATE OF CORRECTION

PATENT NO. : 4,695,918

DATED : September 22, 1987

INVENTOR(S) : Raymond P. O'Leary

It is certified that error appears in the above-identified patent and that said Letters Patent is hereby corrected as shown below:

Col. 13, lines 36 and 37, "and-/or" should be -- and/or --.

Signed and Sealed this

Fifteenth Day of March, 1988

*Attest:*

*Attesting Officer*

DONALD J. QUIGG

*Commissioner of Patents and Trademarks*